US010115371B2

(12) United States Patent
Fu et al.

(10) Patent No.: US 10,115,371 B2
(45) Date of Patent: Oct. 30, 2018

(54) LOOK UP TABLE MANAGEMENT METHOD OF LIQUID CRYSTAL DISPLAY AND DEVICE

(71) Applicant: Shenzhen China Star Optoelectronics Technology Co., Ltd., Shenzhen, Guangdong (CN)

(72) Inventors: Yuhong Fu, Guangdong (CN); Liwei Zhu, Guangdong (CN); Wenqin Zhao, Guangdong (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 321 days.

(21) Appl. No.: 14/916,569

(22) PCT Filed: Jan. 6, 2016

(86) PCT No.: PCT/CN2016/070242
§ 371 (c)(1),
(2) Date: Mar. 4, 2016

(87) PCT Pub. No.: WO2017/096685
PCT Pub. Date: Jun. 15, 2017

(65) Prior Publication Data

US 2017/0301311 A1 Oct. 19, 2017

(30) Foreign Application Priority Data

Dec. 10, 2015 (CN) ..... 2015 1 0917863

(51) Int. Cl.
*G09G 3/36* (2006.01)
*G09G 5/06* (2006.01)

(52) U.S. Cl.
CPC ..... *G09G 5/06* (2013.01); *G09G 3/36* (2013.01); *G09G 3/3648* (2013.01);
(Continued)

(58) Field of Classification Search
CPC ... G09G 2320/0693; G09G 2320/0285; G09G 2320/0626; G09G 2320/0673;
(Continued)

(56) References Cited

U.S. PATENT DOCUMENTS 7,027,088 B1 * 4/2006 Kuwata ..... H04N 1/40 348/234
8,836,625 B2 * 9/2014 Cheon ..... G09G 3/3648 345/87

(Continued)

*Primary Examiner* — Duc Q Dinh
(74) *Attorney, Agent, or Firm* — Andrew C. Cheng

(57) ABSTRACT

The embodiment of the present invention discloses a look up table management method of a liquid crystal display and a device. The method can include: obtaining an input data and an output data from a first look up table; performing preset operation to the output data to obtain a middle data, of which a sum of absolute values is smaller than a sum of the output data, and associatively storing the input data and the middle data to be a second look up table; as the liquid crystal display performs display, performing an inverse operation of the preset operation to the middle data in the second look up table which is corresponded with a display data inputted in real time to obtain and output an output data corresponded with the display data.

3 Claims, 2 Drawing Sheets

(52) U.S. Cl.
CPC ..... *G09G 2300/0452* (2013.01); *G09G 2320/0285* (2013.01); *G09G 2320/0666* (2013.01); *G09G 2360/08* (2013.01); *G09G 2360/16* (2013.01)

(58) Field of Classification Search
CPC ..... G09G 2320/0606; G09G 3/006; G09G 2320/0276; G09G 3/36; G09G 2320/0252; G09G 2320/028; G09G 3/2007; G09G 2330/021; G09G 3/3233; G09G 5/02; G09G 5/06; H04N 9/77; H04N 1/6019; H04N 1/6052; H04N 5/20; H04N 5/202
USPC ..... 345/87, 98, 99, 100
See application file for complete search history.

(56) References Cited

U.S. PATENT DOCUMENTS

2005/0212825 A1* 9/2005 Lee ..... G09G 5/10 345/690
2013/0044098 A1* 2/2013 Nakata ..... G09G 3/3655 345/212
2015/0084996 A1* 3/2015 Yamakawa ..... H04N 9/73 345/690

* cited by examiner

LOOK UP TABLE MANAGEMENT METHOD OF LIQUID CRYSTAL DISPLAY AND DEVICE

CROSS REFERENCE

This application claims the priority of Chinese Patent Application No. 201510917863.X, entitled "Look up table management method of liquid crystal display and device", filed on Dec. 10, 2015, the disclosure of which is incorporated herein by reference in its entirety.

FIELD OF THE INVENTION

The present invention relates to a display technology field, and more particularly to a look up table management method of a liquid crystal display and a device.

BACKGROUND OF THE INVENTION

Recently, Liquid Crystal Display (LCD) has gradually become the most widely utilized flat panel display element due to the advantages of high resolution, low power consumption, being compact and portable. With some properties of the liquid crystal material, the liquid crystal display inevitably has some issues that the other displays do not have. For instance, the chroma point offset issue due to dark state light leakage cause by the liquid crystal twist angle, or the kinetic blur and double image issues due to the liquid crystal response time can be illustrated. For improving these issues, the image data or the video data needs to be adjusted. The prior art is to store some Look-up Table (LUT) in the liquid crystal display. The image data or the video data is adjusted according to the Look-up Table. However, the Look-up Table contains a large amount of data, which requires occupying more internal storage resource and is not beneficial for optimization of the liquid crystal display.

SUMMARY OF THE INVENTION

The present invention provides a look up table management method and device of a liquid crystal display. It can save the external storage resource and the internal storage resource of the driving circuit in the liquid crystal display to reduce the storage cost.

The embodiment of the present invention provides a look up table management method of a liquid crystal display, comprising:

obtaining an input data and an output data from a first look up table;

performing preset operation to the output data to obtain a middle data, of which a sum of absolute values is smaller than a sum of the output data, and associatively storing the input data and the middle data to be a second look up table;

as the liquid crystal display performs display, performing an inverse operation of the preset operation to the middle data in the second look up table which is corresponded with a display data inputted in real time to obtain and output an output data corresponded with the display data.

As being a possible embodiment, the step of performing preset operation to the output data to obtain the middle data, of which the sum of absolute values is smaller than the sum of the output data comprises:

operating to obtain the middle data Dm according to an equation $Dm=|Do-Di*2N|$, wherein Do is the output data, and Di is the input data, and $|Do-Di*2N|\leq Do$, and the N is a natural number.

As being a possible embodiment, the first look up table is a white balance look up table, and the N=2.

As being a possible embodiment, the first look up table is a overdrive OD look up table, and the input data Di of different values in the OD look up table correspond to N of different values, and each input data Di and the corresponding N and the output data Do satisfy a relationship $|Do-Di*2N|\leq 2M$, and the M is a positive integer, and the $2M\leq Do$.

As being a possible embodiment, the M=8.

Second, the embodiment of the present invention provides a look up table management device of a liquid crystal display, comprising:

a reading unit, obtaining an input data and an output data from a first look up table;

a first operation unit, performing preset operation to the output data to obtain a middle data, of which a sum of absolute values is smaller than a sum of the output data;

a storing unit, employed to associatively store the input data and the middle data to be a second look up table;

a second operation unit, as the liquid crystal display performs display, performing an inverse operation of the preset operation to the middle data in the second look up table which is corresponded with a display data inputted in real time to obtain and output an output data corresponded with the display data.

As being a possible embodiment, the first operation unit is specifically employed for:

operating to obtain the middle data Dm according to an equation $Dm=|Do-Di*2N|$, wherein Do is the output data, and Di is the input data, and $|Do-Di*2N|\leq Do$, and the N is a natural number.

As being a possible embodiment, the first look up table is a white balance look up table, and the N=2.

As being a possible embodiment, the first look up table is a overdrive OD look up table, and the input data Di of different values in the OD look up table correspond to N of different values, and each input data Di and the corresponding N and the output data Do satisfy a relationship $|Do-Di*2N|\leq 2M$, and the M is a positive integer, and the $2M\leq Do$.

As being a possible embodiment, the M=8.

The embodiment of the present invention comprises obtaining an input data and an output data from a first look up table; performing preset operation to the output data to obtain a middle data, of which a sum of absolute values is smaller than a sum of the output data, and associatively storing the input data and the middle data to be a second look up table; as the liquid crystal display performs display, performing an inverse operation of the preset operation to the middle data in the second look up table which is corresponded with a display data inputted in real time to obtain and output an output data corresponded with the display data. With utilization of the embodiment of the present invention, the data amount of the middle data is smaller, and the occupied storage space is small. It can save the external storage resource and the internal storage resource of the driving circuit in the liquid crystal display to reduce the storage cost.

BRIEF DESCRIPTION OF THE DRAWINGS

In order to more clearly illustrate the embodiments of the present invention or prior art, the following figures will be described in the embodiments are briefly introduced. It is obvious that the drawings are merely some embodiments of the present invention, those of ordinary skill in this field can obtain other figures according to these figures without paying the premise.

DETAILED DESCRIPTION OF PREFERRED EMBODIMENTS

Embodiments of the present invention are described in detail with the technical matters, structural features, achieved objects, and effects with reference to the accompanying drawings as follows. It is clear that the described embodiments are part of embodiments of the present invention, but not all embodiments. Based on the embodiments of the present invention, all other embodiments to those of ordinary skill in the premise of no creative efforts obtained, should be considered within the scope of protection of the present invention.

The present invention provides a look up table management method and device of a liquid crystal display. It can save the external storage resource and the internal storage resource of the driving circuit in the liquid crystal display to reduce the storage cost. The detail descriptions are respectively introduced below.

Figure 1:
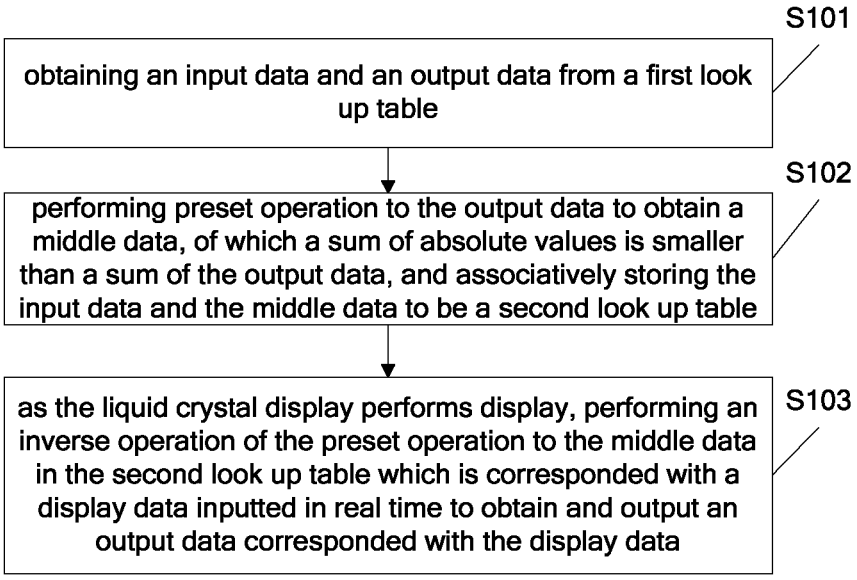
FIG. 1 is a flowchart of a look up table management method of a liquid crystal display provided by one embodiment of the present invention.

Please refer to FIG. 1, which is a flowchart of a look up table management method of a liquid crystal display provided by one embodiment of the present invention. As shown in FIG. 1, the method can comprises steps of:

S101, obtaining an input data and an output data from a first look up table.

In the specific embodiment, the first look up table comprises kinds of input data and output data corresponding thereto. For instance, for an 8 digital image liquid crystal display utilizing the RGB three primary colors, the input data comprises R from 0 to 255, G from 0 to 255, B from 0 to 255, which are 768 in total. Each input data exclusively corresponds to one output data.

Selectably, the first look up table is a white balance look up table or an overdriving look up table. The output data corresponding to kinds of input data in the first look up table can be tested and confirmed by the technical employee, or obtained with some parameter adjustment tool of the liquid crystal display panel. In the embodiment of the present invention, the input data and the output data in the first look up table obtained by the input of the technical employee or from other equipments are not directly stored in the first look up table.

In prior art, as the liquid crystal display works, the internal data driving circuit controls the color of each pixel dot in the liquid crystal panel according to the received input data to make the liquid crystal panel show the preset image. For improving the chroma point offset issue of the liquid crystal panel, the driving circuit of the liquid crystal panel stores a white balance look up table inside. As receiving the inputted RGB data, the corresponding RGB output data is searched in the white balance look up table, and the corresponding RGB output data is outputted to the liquid crystal panel. Similarly, for improving the lagging image and double image issues of the liquid crystal panel, the driving circuit of the liquid crystal panel stores an Over Driving (OD) look up table inside. As receiving the inputted driving voltage data, the corresponding driving voltage output data is searched in the OD look up table, and the corresponding driving voltage output data is outputted to the liquid crystal panel. Normally, the data value of the output data is larger, and requires occupying more storage spaces for storage.

S102, performing preset operation to the output data to obtain a middle data, of which a sum of absolute values is smaller than a sum of the output data, and associatively storing the input data and the middle data to be a second look up table.

In specific embodiment, the first look up table comprises a plurality of input data and a plurality of output data. The embodiment of the present invention performs the preset operation to each output data to obtain a plurality of middle data respectively corresponding to the input data. After the preset operation, a sum of the absolute values of all the middle data is smaller than a sum of all the output data. The larger the absolute value is, the larger storage space is required. Therefore, the space required for storing the middle data is smaller than the space required for storing the output data.

Preferably, for saving the resource consumption of the operation, the aforesaid preset operation can utilize the adder operation consuming less hardware resource and the shift operation consuming no hardware resource. For example, with the value that the output data minus the input data and moving toward left with few digitals, the middle data of smaller value can be obtained.

After performing the operation to each output data to obtain the corresponding middle data, the mapping relationship between the middle data and the input data corresponded with the output data is established to obtain a second look up table and to store the same.

In the specific embodiment, the second look up table can be stored in the EEPROM (Electrically Erasable Programmable Read-Only Memory) outside the driving circuit of the liquid crystal display. When the liquid crystal display is powered on, the second look up table in the EEPROM is red to the SRAM (Static Random Access Memory) in the driving circuit.

S103, as the liquid crystal display performs display, performing an inverse operation of the preset operation to the middle data in the second look up table which is corresponded with a display data inputted in real time to obtain and output an output data corresponded with the display data.

When the liquid crystal display works, the output data corresponding to the real time inputted display data needs to be confirmed according to the first look up table and is outputted to the liquid crystal panel. Because the embodiment of the present invention does not store the output data in the first look up table but stores the middle data obtained after the preset operation is performed to the output data of the first look up table, therefore, an inverse operation of the preset operation to the middle data is required for recovering the output data. Specifically, first, the corresponding middle data is searched from the second look up table according to the real time inputted display data, and the inverse operation of the preset operation to the middle data is performed to the middle data to obtain the output data corresponding to the real time inputted display data, and then the output data is outputted to the liquid crystal panel.

The embodiment of the present invention comprises obtaining an input data and an output data from a first look up table; performing preset operation to the output data to obtain a middle data, of which a sum of absolute values is smaller than a sum of the output data, and associatively storing the input data and the middle data to be a second look up table; as the liquid crystal display performs display, performing an inverse operation of the preset operation to the middle data in the second look up table which is corresponded with a display data inputted in real time to obtain and output an output data corresponded with the display data. With utilization of the embodiment of the present invention, the data amount of the middle data is smaller, and the occupied storage space is small. It can save the external storage resource and the internal storage resource of the driving circuit in the liquid crystal display to reduce the storage cost.

Figure 2:
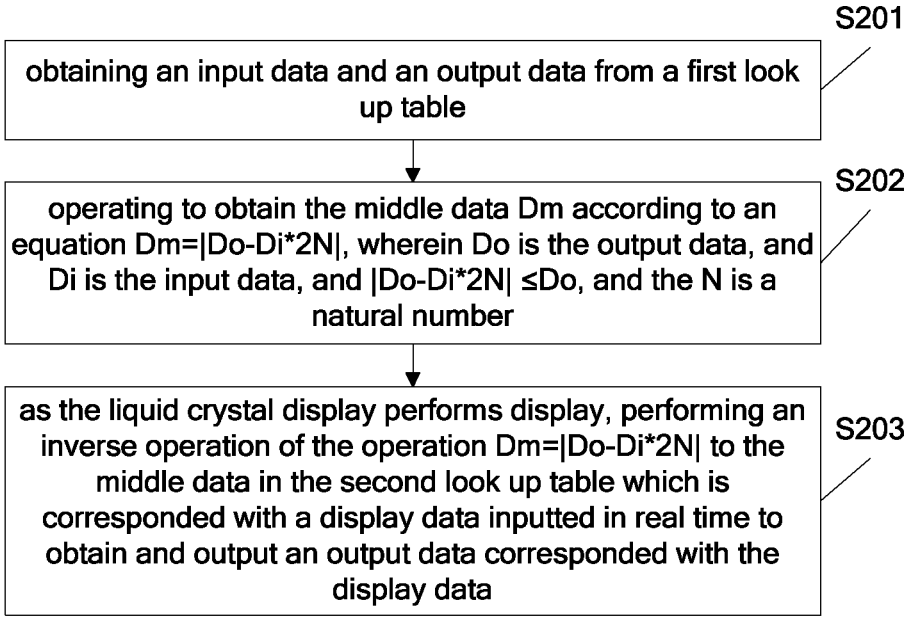
FIG. 2 is a flowchart of a look up table management method of a liquid crystal display provided by another embodiment of the present invention.

Please refer to FIG. 2, which is a flowchart of a look up table management method of a liquid crystal display provided by another embodiment of the present invention. As shown in FIG. 2, the method can comprises steps of:

S201, obtaining an input data and an output data from a first look up table.

In the specific embodiment, the first look up table comprises kinds of input data and output data corresponding thereto. For instance, for an 8 digital image liquid crystal display utilizing the RGB three primary colors, the input data comprises R from 0 to 255, G from 0 to 255, B from 0 to 255, which are 768 in total. Each input data exclusively corresponds to one output data.

Selectably, the first look up table is a white balance look up table or an overdriving look up table. The output data corresponding to kinds of input data in the first look up table can be tested and confirmed by the technical employee, or obtained with some parameter adjustment tool of the liquid crystal display panel. In the embodiment of the present invention, the input data and the output data in the first look up table obtained by the input of the technical employee or from other equipments are not directly stored in the first look up table.

In prior art, as the liquid crystal display works, the internal data driving circuit controls the color of each pixel dot in the liquid crystal panel according to the received input data to make the liquid crystal panel show the preset image. For improving the chroma point offset issue of the liquid crystal panel, the driving circuit of the liquid crystal panel stores a white balance look up table inside. As receiving the inputted RGB data, the corresponding RGB output data is searched in the white balance look up table, and the corresponding RGB output data is outputted to the liquid crystal panel. Meanwhile, for improving the lagging image and double image issues of the liquid crystal panel, the driving circuit of the liquid crystal panel stores an OD look up table inside. As receiving the inputted driving voltage data, the corresponding driving voltage output data is searched in the OD look up table, and the corresponding driving voltage output data is outputted to the liquid crystal panel. Normally, the data value of the output data is larger, and requires occupying more storage spaces for storage.

S202, operating to obtain the middle data Dm according to an equation $Dm=|Do-Di*2N|$, wherein Do is the output data, and Di is the input data, and $|Do-Di*2N|\leq Do$, and the N is a natural number.

In specific embodiment, the first look up table comprises a plurality of input data Di and a plurality of output data Do. The embodiment of the present invention performs the $|Do-Di*2N|$ operation to each output data Do to obtain a middle data Dm. The hardware realizes performing the operation with binary, and $Di*2N$ is practically to move the input data Di to the left with N digitals, and the left movement operation does not consume the hardware resource. After the input data Di is moved to the left with N digitals, the difference between the same and the output data Do can be operated with the adder. The consumed hardware resource of the adder is less. Therefore, the $|Do-Di*2N|$ operation does not increase the logic operation resource consumption of the driving circuit.

In some possible embodiments, in case that the first look up table is a white balance look up table, and the N=2. Specifically, the output data in the white balance look up table is generally four times of the input data. If N=2, then the value of middle data $Dm=|Do-Di*2N|$ is smaller, and each middle data can use 1 byte (8 bit) for storage. The RGB three colors totally have 256*3 middle data, and the occupied space for storing the second look up table is 256*3*8 bit=6144 bit. In prior art, each output data in the white balance look up table generally uses 10 bits for storage. The occupied total space of the output data for storing the white balance look up table is 256*3*10=7680 bit. In condition that the white balance look up table is replaced with the second look up table for storage. The 1536 bit external storage space and 1536 bit internal buffer space can be saved.

In some other possible embodiments, if the first look up table is the overdriving OD look up table, and the multiple relationship between the output data Do and the input data Di in the OD look up table is not obvious, the input data Di of various values in the OD look up table can correspond to the N of different values as long as that the relationship among each input data Di, and the corresponding N and the output data Do satisfy the relationship, $|Do-Di*2N|\leq 2M$. The M is a positive integer, and the $2M\leq Do$. Specifically, the M should be smaller than the digital number of the output data Do in the OD look up table. For instance, in case that the output data Do in the OD look up table is stored with 12 bit, then the M=8. Preferably, for convenient operation, the M can be set to be a constant value.

S203, as the liquid crystal display performs display, performing an inverse operation of the operation $Dm=|Do-Di*2N|$ to the middle data in the second look up table which is corresponded with a display data inputted in real time to obtain and output an output data corresponded with the display data.

When the liquid crystal display works, the output data corresponding to the real time inputted display data needs to be confirmed according to the first look up table and is outputted to the liquid crystal panel. Because the embodiment of the present invention does not store the output data in the first look up table but stores the middle data Dm obtained after the $|Do-Di*2N|$ operation is performed to the output data of the first look up table. Therefore, an inverse operation of the preset operation to the middle data is required for recovering the output data Do. Specifically, first, the corresponding middle data Dm is searched from the second look up table according to the real time inputted display data, and the $Do=Dm\pm Di*2N$ operation to the middle data is performed to the middle data to obtain the output data Do corresponding to the real time inputted display data, and then the output data is outputted to the liquid crystal panel. In case that $Do-Di*2N>0$, the plus is taken. In case that $Do-Di*2N\leq 0$, the minus is taken.

The embodiment of the present invention comprises obtaining an input data and an output data from a first look up table; performing operation according to $Dm=|Do-Di*2N|$ operation to obtain a middle data Dm to make each middle data $Dm\leq Do$, and associatively storing the input data Di and the middle data Dm to be a second look up table; as the liquid crystal display performs display, performing an inverse operation of the preset operation to the middle data in the second look up table which is corresponded with a display data inputted in real time to obtain and output an output data corresponded with the display data. With utilization of the embodiment of the present invention, the data amount of the middle data is smaller, and the occupied storage space is small. It can save the external storage resource and the internal storage resource of the driving circuit in the liquid crystal display to reduce the storage cost.

Figure 3:
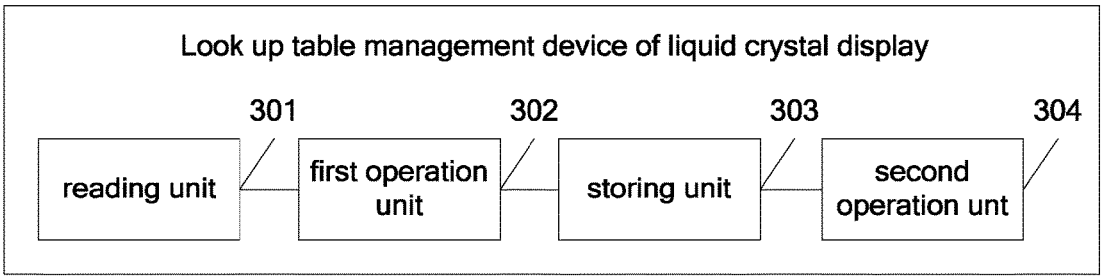
FIG. 3 is a structure diagram of a look up table management device of a liquid crystal display provided by one embodiment of the present invention.

Please refer to FIG. 3, which is a structure diagram of a look up table management device of a liquid crystal display provided by one embodiment of the present invention. As shown in FIG. 3, the device can comprises:

a reading unit 301, obtaining an input data and an output data from a first look up table.

In the specific embodiment, the first look up table comprises kinds of input data and output data corresponding thereto. For instance, for an 8 digital image liquid crystal display utilizing the RGB three primary colors, the input data comprises R from 0 to 255, G from 0 to 255, B from 0 to 255, which are 768 in total. Each input data exclusively corresponds to one output data.

Selectably, the first look up table is a white balance look up table or an overdriving look up table. The output data corresponding to kinds of input data in the first look up table can be tested and confirmed by the technical employee, or obtained with some parameter adjustment tool of the liquid crystal display panel. In the embodiment of the present invention, the input data and the output data in the first look up table obtained by the input of the technical employee or from other equipments are not directly stored in the first look up table.

In prior art, as the liquid crystal display works, the internal data driving circuit controls the color of each pixel dot in the liquid crystal panel according to the received input data to make the liquid crystal panel show the preset image. For improving the chroma point offset issue of the liquid crystal panel, the driving circuit of the liquid crystal panel stores a white balance look up table inside. As receiving the inputted RGB data, the corresponding RGB output data is searched in the white balance look up table, and the corresponding RGB output data is outputted to the liquid crystal panel. Meanwhile, for improving the lagging image and double image issues of the liquid crystal panel, the driving circuit of the liquid crystal panel stores an OD look up table inside. As receiving the inputted driving voltage data, the corresponding driving voltage output data is searched in the OD look up table, and the corresponding driving voltage output data is outputted to the liquid crystal panel. Normally, the data value of the output data is larger, and requires occupying more storage spaces for storage.

a first operation unit 302, performing preset operation to the output data to obtain a middle data, of which a sum of absolute values is smaller than a sum of the output data.

In specific embodiment, the first look up table comprises a plurality of input data and a plurality of output data. The embodiment of the present invention performs the preset operation to each output data to obtain a plurality of middle data respectively corresponding to the input data. After the preset operation, a sum of the absolute values of all the middle data is smaller than a sum of all the output data. The larger the absolute value is, the larger storage space is required. Therefore, the space required for storing the middle data is smaller than the space required for storing the output data.

Preferably, for saving the resource consumption of the operation, the aforesaid preset operation can utilize the adder operation consuming less hardware resource and the shift operation consuming no hardware resource. For example, with the value that the output data minus the input data and moving toward left with few digitals, the middle data of smaller value can be obtained. Then, the first operation unit 302 can be realized with the shift operation circuit and the add circuit.

After performing the operation to each output data to obtain the corresponding middle data, the mapping relationship between the middle data and the input data corresponded with the output data is established to obtain a second look up table.

As being a possible embodiment, the first operation unit 302 can operate to obtain the middle data Dm according to an equation $Dm=|Do-Di*2N|$, wherein Do is the output data, and Di is the input data, and $|Do-Di*2N|\leq Do$, and the N is a natural number.

In specific embodiment, the first look up table comprises a plurality of input data Di and a plurality of output data Do. The embodiment of the present invention performs the $|Do-Di*2N|$ operation to each output data Do to obtain a middle data Dm. The hardware realizes performing the operation with binary, and $Di*2N$ is practically to move the input data Di to the left with N digitals, and the left movement operation does not consume the hardware resource. After the input data Di is moved to the left with N digitals, the difference between the same and the output data Do can be operated with the adder. The consumed hardware resource of the adder is less. Therefore, the $|Do-Di*2N|$ operation does not increase the logic operation resource consumption of the driving circuit.

In some possible embodiments, in case that the first look up table is a white balance look up table, and the N=2.Specifically, the output data in the white balance look up table is generally four times of the input data. If N=2, then the value of middle data $Dm=|Do-Di*2N|$ is smaller, and each middle data can use 1 byte (8 bit) for storage. The RGB three colors totally have 256*3 middle data, and the occupied space for storing the second look up table is 256*3*8 bit=6144 bit. In prior art, each output data in the white balance look up table generally uses 10 bits for storage. The occupied total space of the output data for storing the white balance look up table is 256*3*10=7680 bit. In condition that the white balance look up table is replaced with the second look up table for storage. The 1536 bit external storage space and 1536 bit internal buffer space can be saved.

In some other possible embodiments, if the first look up table is the overdriving OD look up table, and the multiple relationship between the output data Do and the input data Di in the OD look up table is not obvious, the input data Di of various values in the OD look up table can correspond to the N of different values as long as that the relationship among each input data Di, and the corresponding N and the output data Do satisfy the relationship, $|Do-Di*2N|\leq 2M$. The M is a positive integer, and the $2M\leq Do$. Specifically, the M should be smaller than the digital number of the output data Do in the OD look up table. For instance, in case that the output data Do in the OD look up table is stored with 12 bit, then the M=8. Preferably, for convenient operation, the M can be set to be a constant value.

a storing unit 303, employed to associatively store the input data and the middle data to be a second look up table.

In the specific embodiment, the second look up table can be stored in the EEPROM (Electrically Erasable Programmable Read-Only Memory) outside the driving circuit of the liquid crystal display. When the liquid crystal display is powered on, the second look up table in the EEPROM is red to the SRAM (Static Random Access Memory) in the driving circuit.

a second operation unit 304, as the liquid crystal display performs display, performing an inverse operation of the preset operation to the middle data in the second look up table which is corresponded with a display data inputted in real time to obtain and output an output data corresponded with the display data.

When the liquid crystal display works, the output data corresponding to the real time inputted display data needs to be confirmed according to the first look up table and is outputted to the liquid crystal panel. Because the embodiment of the present invention does not store the output data in the first look up table but stores the middle data obtained after the preset operation is performed to the output data of the first look up table, therefore, an inverse operation of the preset operation to the middle data is required for recovering the output data. Specifically, first, the corresponding middle data is searched from the second look up table according to the real time inputted display data, and the inverse operation of the preset operation to the middle data is performed to the middle data to obtain the output data corresponding to the real time inputted display data, and then the output data is outputted to the liquid crystal panel.

The embodiment of the present invention comprises obtaining an input data and an output data from a first look up table; performing preset operation to the output data to obtain a middle data, of which a sum of absolute values is smaller than a sum of the output data, and associatively storing the input data and the middle data to be a second look up table; as the liquid crystal display performs display, performing an inverse operation of the preset operation to the middle data in the second look up table which is corresponded with a display data inputted in real time to obtain and output an output data corresponded with the display data. With utilization of the embodiment of the present invention, the data amount of the middle data is smaller, and the occupied storage space is small. It can save the external storage resource and the internal storage resource of the driving circuit in the liquid crystal display to reduce the storage cost.

Correspondingly, the embodiment of the present invention further provides a liquid crystal display. The liquid crystal display can comprise at least one look up table management device shown in FIG. 3. Specifically, the at least one look up table management device can be located inside the driving circuit of the liquid crystal panel.

Above are embodiments of the present invention, which does not limit the scope of the present invention. Any modifications, equivalent replacements or improvements within the spirit and principles of the embodiment described above should be covered by the protected scope of the invention.

What is claimed is:

1. A method for managing a look up table of a liquid crystal display to reduce internal storage capacity of the look up table thereof, comprising the steps of:

obtaining an input data (Di) and an output data (Do) from a first look up table configured with an overdrive (OD) look up table, and the input data of different values in the OD look up table correspond to an N of different values, and each input data and the corresponding N and the output data satisfy a relationship defined by an equation of $|Do-Di*2N|\leq 2M$, and wherein the M is a positive integer, and the $2M \leq Do$;

performing preset operation to the output data to obtain a middle data (Dm) through the equation $Dm=|Do-Di*2N|$, wherein $|Do-Di*2N|\leq Do$, and the N is a natural number, wherein a sum of absolute values is smaller than a sum of the output data, and associatively storing the input data and the middle data as a second look up table; and wherein when the liquid crystal display is to display an image, performing an inverse operation of the preset operation to the middle data stored in the second look up table which is corresponded with a display data inputted in real time to obtain and output an output data corresponded with the display data.

2. The method according to claim 1, wherein the N=2.

3. The method according to claim 1, wherein the M=8.

* * * * *